US005239734A

United States Patent [19]

Bathelier et al.

[11] Patent Number: 5,239,734

[45] Date of Patent: Aug. 31, 1993

[54] PROCESS AND DEVICE FOR MANUFACTURING TEXTILE PRODUCTS FROM FIBRES AND/OR FILAMENTS AND PRODUCTS OBTAINED

[75] Inventors: Xavier Bathelier, Raucourt; Gilles Januzec, Sedan, both of France

[73] Assignee: Sommer S.A., France

[21] Appl. No.: 781,227

[22] PCT Filed: Jun. 30, 1989

[86] PCT No.: PCT/EP90/01028

§ 371 Date: Dec. 30, 1991

§ 102(e) Date: Dec. 30, 1991

[87] PCT Pub. No.: WO91/00383

PCT Pub. Date: Jan. 10, 1991

[51] Int. Cl.[5] ..... D04H 1/74; B32B 5/06; D05C 15/00

[52] U.S. Cl. ..... 28/107; 112/80.73

[58] Field of Search ..... 28/107, 109, 108; 112/318, 322, 80.73

[56] References Cited

U.S. PATENT DOCUMENTS

| | | | |
|---|---|---|---|
| 3,605,666 | 9/1971 | Kimmet et al. | 28/109 X |
| 3,613,190 | 10/1971 | Crosby | 28/109 |
| 3,695,270 | 10/1972 | Dostal | 28/107 X |
| 4,096,302 | 6/1978 | Thibodeau et al. | 28/109 X |
| 4,379,189 | 4/1983 | Platt | 28/107 X |
| 4,416,936 | 11/1983 | Erickson et al. | 28/107 X |
| 4,418,104 | 11/1983 | Kiyomura et al. | 28/107 X |
| 4,433,018 | 2/1984 | Tesch | 28/107 X |
| 4,622,253 | 11/1986 | Levy | 28/107 X |
| 4,818,586 | 4/1989 | Smith et al. | 28/107 X |

FOREIGN PATENT DOCUMENTS

| | | | |
|---|---|---|---|
| 1404150 | 5/1965 | France | 112/80.73 |
| 0159353 | 3/1983 | German Democratic Rep. | 28/109 |

*Primary Examiner*—Clifford D. Crowder
*Assistant Examiner*—John J. Calvert
*Attorney, Agent, or Firm*—Kolisch Hartwell Dickinson McCormack & Heuser

[57] ABSTRACT

The present invention relates to a process for manufacturing a textile product by starting with fibers and/or filaments in which these fibers and/or filaments travel in the form of a web. The technique consists in subjecting the fibers and/or filaments to a transverse looping accompanied by drawing and that the latter are accumulated in the form of loops in which the fibers and/or filaments are parallelised.

18 Claims, 4 Drawing Sheets

3
1
5a
5b
3a
11
21
31
31a
25
45
43
47

Fig. 4a
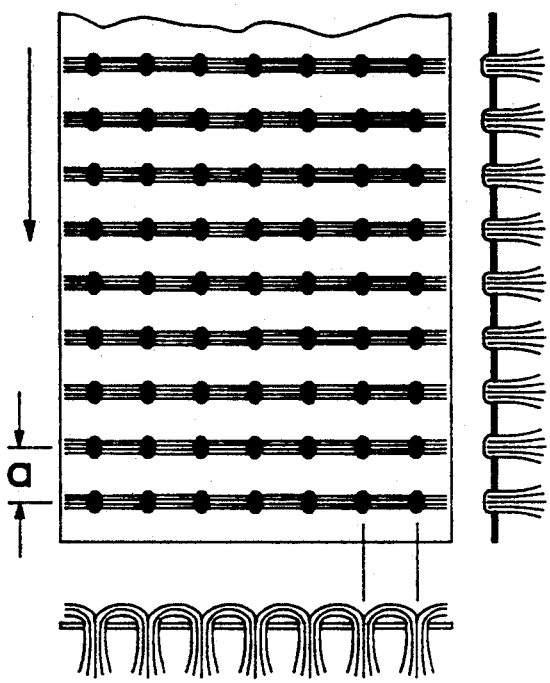
Fig. 4b
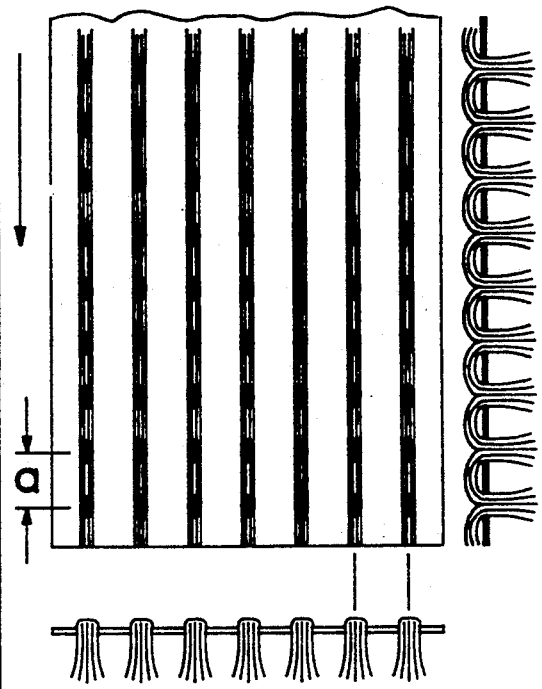
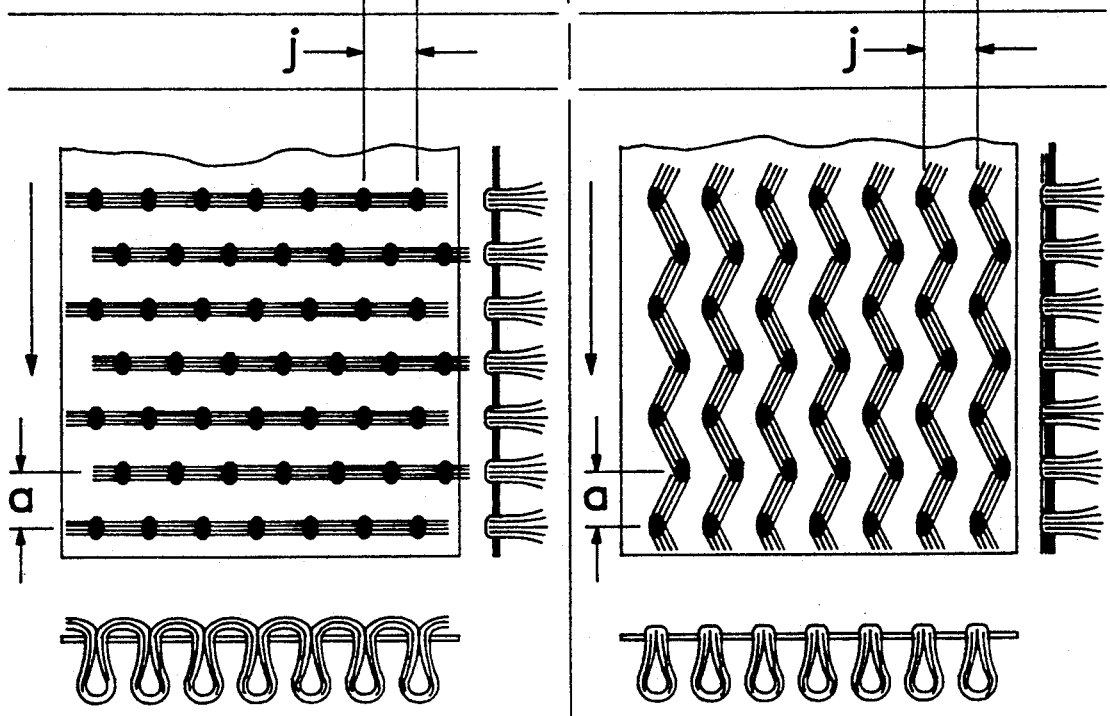
Fig. 4c
Fig. 4d

PROCESS AND DEVICE FOR MANUFACTURING TEXTILE PRODUCTS FROM FIBRES AND/OR FILAMENTS AND PRODUCTS OBTAINED

SUBJECT OF THE INVENTION

The present invention relates to an improved process for manufacturing textile products from fibres and/or filaments and more particularly floor and wall coverings, especially of the moquette type. The invention also relates to a device allowing this process to be implemented and extends to the products resulting from this process and/or obtained using the said device.

The invention will be described essentially with reference to the production of a floor covering of the moquette type by starting with fibres. It must be obvious, however, that it is not limited thereto.

SUMMARY OF THE PRIOR ART

Apart from traditional and ancient methods of manufacture of carpets and tapestries, which resort to weaving and/or knotting methods, two large classes of recent techniques for producing products intended especially for covering floors and walls are known.

The first large class, tufting, makes use of threads, in particular threads spun from fibres such as wool or threads obtained from continuous filaments, for example polyamide or other synthetic substances.

In the field of textile coverings it is these products that meet with the greatest success because it is possible to combine a highly mechanised production, when compared with weaving techniques, while retaining a product appearance which is close to that of woven products.

A second class consists of techniques employing fibres. Among these, the needling technique employs chiefly textile fibres which are preferably arranged in layers. The looped or structured needled wad allows a little material (fibres) to be pulled out of the fibre layer with the aid of a needle to form a "loop" which can be sheared or cropped.

The appearance of the sheared or cropped product is quite close to that of the velvet tufted products which are, in their case, obtained by cutting the loops of a tuft.

On the other hand, a looped needled product cannot in any case be compared with a tuft. In fact, the loops are not individualised and the fibres in these loops appear in a random manner.

Moreover, the yield, which characterises the ratio of the quantity of the useful material appearing on the face of the product to the total weight of material employed (without the base) is of the order of 30% in the case of needling, whereas it easily reaches 60 to 80% in the case of the tufted products.

Furthermore, in the case of floor coverings, these products must have a resistance to deformation and to wear and a resilience (elasticity) which are sufficient. It is generally considered that a product for floor covering is satisfactory if the density of the useful velvet is higher than 0.08 g/cm$^3$, a value which the needled products attain with difficulty.

Document EP-0,214,062 describes a quite traditional needling process which permits the yield to be increased by "extirpation" of fibres of great length from the sheet.

However, this product has a special appearance of the synthetic fur type and therefore has an appearance which is very far from the appearance of tufted products.

Document DE-2,450,725 describes a process for obtaining needled products where the looped sheet has been integrally fixed to the base using ultrasonics. This process is an attempt to "verticalise" as many fibres as possible and thus to increase the yield.

In this process the grooved roll is used both for reacting to the penetrating forces of the needles and for conveying the embrittled sheet as far as the L point of the integral fixing, whereas in a traditional looping process the sheet is drawn by tensioning rolls and must consequently have a sufficient planar cohesion.

However, as the logic of this process is still that of conventional needling, this process has the disadvantage of requiring forces for entering and breaking numerous fibres. Despite an improved yield, this results in the resistance to wear being compromised.

Apart from that, the general appearance of the product obtained by German patent DE-2,450,725 is that of a traditional looped needled product and, in the case of a velvet, there is still a considerable fibre loss.

Finally, the fact of integrally fixing noncontinuously using ultrasonics, whereas the looped product is formed continuously, weakens and limits the process because it requires the use of fusible fibres.

Another technique is the fibre pleating technique described in documents FR-A-2,364,285 and FR-A-2,135,104, which makes it possible to arrange a fibre layer pleated in parallel lengthwise pleats over another fibre layer. However, this technique does not permit the individualisation of the loops or velvet tufts and the formation of fine gauges. In addition, since this technique requires the striction of the fibre sheet, the initial width of the sheet must be markedly greater than the width of the finished textile product.

For the sake of completeness there may also be mentioned the sewing-knitting technique which comprises a stitching operation with the aid of a thread or starting directly with fibres, on a base of a starting material consisting of a woven or nonwoven product. In this case the products obtained are of very little value where appearance is concerned; in addition not all the fibres actually take part in the stitching actually; and this limits the use of these products as floor coverings. This is why these products are found essentially in the form of fur.

Another disadvantage of this sewing-knitting technique is the small working width (2.40 m), whereas tufted products are generally manufactured in 4-meter width.

It may be considered that the various techniques referred to above have attempted to approach the results obtained by tufting, but not very successfully.

OBJECTIVES OF THE INVENTION

A first objective of the invention is to manufacture a covering of the tufted type by starting with cheap textile materials, without necessarily having to employ thread.

Another major objective of the invention is to greatly reduce the energy to be employed for "verticalising" the loops by starting with a web and hence to avoid breaking the fibres while allowing the machine to be dimensioned for a great width (4 m).

What is aimed for very particularly is to obtain a product of high textile yield, exhibiting the intrinsic qualities of tufted products (resilience, resistance to deformation and to wear, etc.) without having to resort to a costly intermediate spinning stage.

The product which it is aimed to obtain must also have a sufficient density to have an adequate mechanical strength which enables it to be employed as floor covering.

In the case where the members forming the web are filaments, the process according to the invention makes it possible to work directly at the exit of extrusion dies, without having to go through the intermediate stages of reeling, for example.

CHARACTERISTIC FEATURES OF THE INVENTION

The present invention relates firstly to a process for manufacturing a textile product by starting with fibres and/or filaments in which these fibres and/or filaments travel in the form of a web. The technique consists in subjecting the fibres and/or filaments to a transverse looping accompanied by a drawing operation and in that these are accumulated in the form of loops in which the fibres and/or filaments are parallelised.

The members constituting the web are subjected to a preliminary treatment so that most of the members of the web have an angle of orientation relative to the direction of forward travel of between 5° and 45°, preferably between 15° and 25°.

Advantageously, and in particular if the aim is greatly to reduce the energy needed to produce a looped product, it is recommended to employ a starting web of fibres and/or filaments of a very low weight per unit area (surface density), preferably of between 10 and 50 g/m$^2$ in the case of the most common fibres and/or filaments.

The desired orientation of the fibres in the web is preferably produced by a predrawing technique, while the filaments are oriented in a desired manner by virtue of traditional lapping techniques, on leaving the extrusion dies.

The transverse looping accompanied by drawing is produced in the case of each fibre or filament with the aid of rotary looping members or discs set at a distance and arranged on a shaft which is transverse in relation to the forward travel of the web, between which looping fingers are arranged. In principle, each fibre or filament is involved in at least one looping.

According to a preferred embodiment, the accumulation of the parallelised fibres and/or filaments in the form of loops can take place in the open eye of needles which are arranged essentially vertically between the looping members. These needles can pierce a base moving in parallel to the forward travel of the web.

After the base has been pierced, the loops are released, preferably according to the traditional tufting technique, optionally involving a hook.

These loops may, however, be attached to a base using other techniques which are known per se, such as sewing, weaving, knitting, welding or gluing, ultrasonic welding, chemical bonding, and the like.

The products obtained thus have well-individualised untwisted loops which can be optionally shorn or cut with the aid of a knife in order to obtain a velvet which is comparable with tufted velvet.

The invention will be described in greater detail by way of illustration, with reference in particular to the device employed according to the invention and to the product resulting therefrom.

Insofar as the device is concerned, it should be clearly understood that this involves an embodiment which is given merely by way of example without any limitation being implied, in the case where the initial web consists solely of fibres.

BRIEF DESCRIPTION OF THE DRAWINGS

FIGS. 4*a, b, c* and *d* show products which are verticalised according to the invention and tufted according to whether the loops have been cut or not.

In the various figures identical or similar constituent members have received identical reference numbers.

Figure 1:
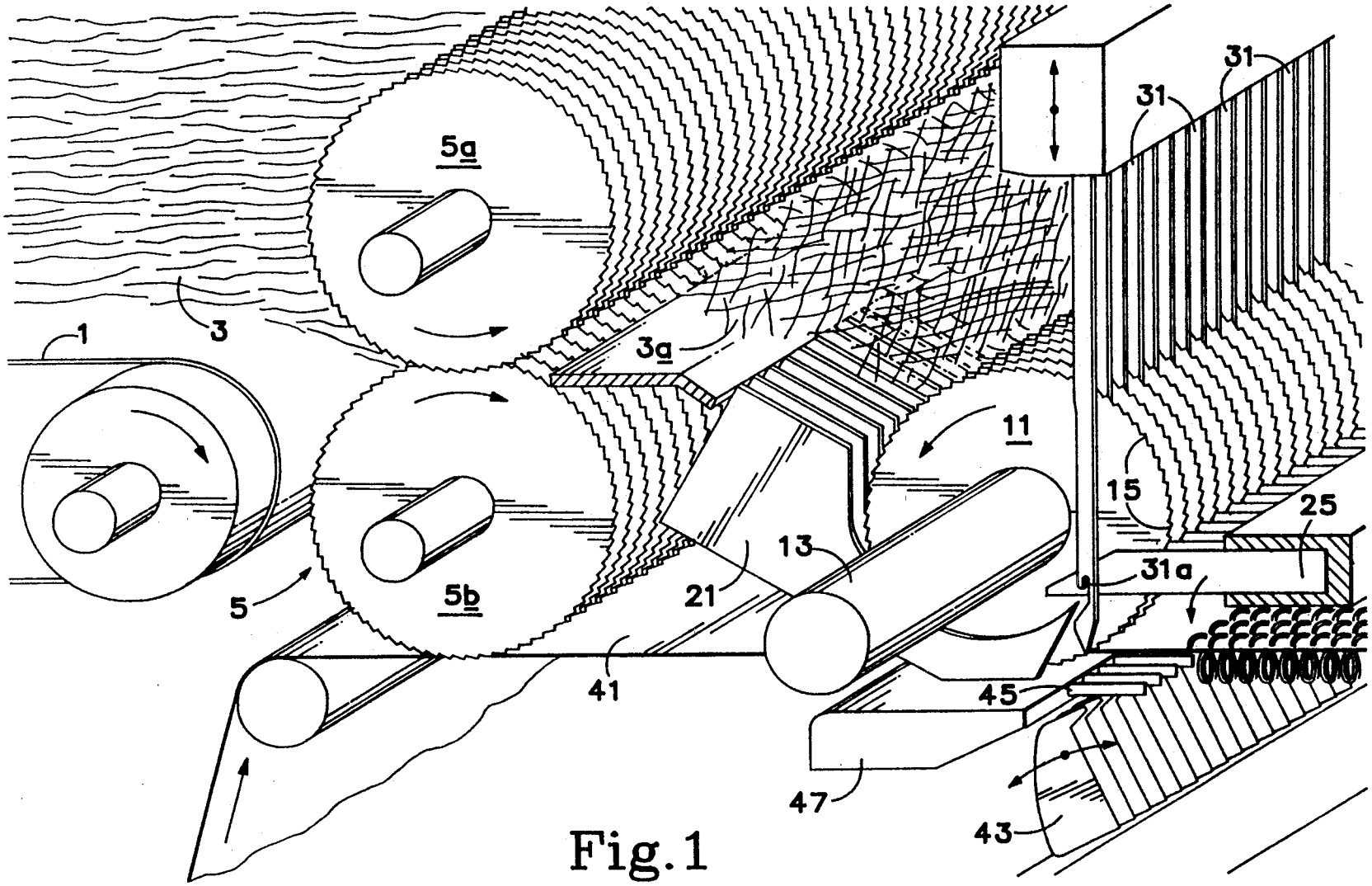
FIG. 1 shows a diagrammatic perspective view of the device used to implement the process according to the invention, in the case where the initial web consists solely of fibres.

DESCRIPTION OF A PREFERRED EMBODIMENT OF THE INVENTION AND OF THE PRINCIPLE ON WHICH IT IS BASED

For a better understanding of the invention it is appropriate to return to the needling technique which was described earlier. In the case of needling, forked needles enter a fibrous medium to extract therefrom fibres which will form loops.

However, since the first fibres which are entrained can only partially slide relative to each other, they necessarily produce a pressure in the medium.

The larger the number of fibres which are seized, the less opportunity they will have to slide and the more pressure they will produce, thus blocking the fibres of the lower layers.

As a result, even if the needles are provided with barbs which are sufficiently deep to receive all the fibres encountered, they will be actually capable of entraining only a small number of these in the form of loops, while generally breaking the other fibres or even causing the needle to break.

Consideration has, of course, been given to reducing this phenomenon by sizing the fibres, the objective being to reduce the coefficient of friction between the fibres and hence the pressures induced in the fibrous medium, and this in fact results in a reduction in the number of fibres which are broken, but without solving the other problems of inadequate density and yield.

It is to solve these difficulties that the measures described above in relation to the process of the invention have been taken.

According to the invention, in fact, the fibres are preferably carded or obtained in another way in the form of a sheet of fibres which have been more or less parallelised and are treated so as to obtain a web of very low weight, preferably between 10 and 50 g/m$^2$. In this fibre web, most of the fibres have an angle of orientation relative to the direction of forward travel of between 5° and 45° and preferably between 15° and 25°. At such a low density of the web the fibres are well individualised and do not interact much. The forces to which a fibre is subjected do not affect the adjacent fibres. The way in which a web of fibres having the orientation shown is obtained will be discussed again below.

Thus prepared, the fibres undergo a looping which is produced by the interpenetration of metal components so as to give each fibre an undulating shape. It should be noted that the looping force F is considerably limited because of the low unit area of the web and of the preferential orientation of the fibres.

In fact, the stress exerted on the fibre is $F-F_O$ in the process according to the invention, with $$F=F_O \exp(2\pi\mu l)/g$$

where $F_O$ is the stress exerted at one end of the fibre;
g is the gauge;
l is the length of the fibre involved in n loops; and
$\mu$ is the friction coefficient.

In the case of a low-density web where the fibres are individualised, $\mu$ then denotes the fibres/metal coefficient and no longer the fibres/fibres coefficient as was the case in the needling technique.

Moreover, the coefficient $\mu$ can be considerably reduced by an appropriate surface treatment of the metal parts, and this further reduces the value of the stress $F-F_O$.

These methods of treatment using a deposition of fluororesin especially on the metal are well known.

Since each fibre loops individually, this operation is equivalent to a drawing operation (as distinct from a transverse pleating of the web), that is to say that the elementary fibres in the web are individually subjected to the looping without a corresponding reduction in the width of the web, and this is radically different from a pleating operating which is accompanied by a constriction in width of the entering sheet.

A consequence of the process according to the invention is that the fibres are virtually never broken.

Furthermore, according to the invention the yield can be optimised if the angle formed by the fibre in relation to the direction of forward movement is greater than $$\alpha_{lim}=\arcsin g/(2h+g),$$

where g is the gauge and
h is the height of the loop.

In fact, for an angle $\alpha$ smaller than $\alpha_{lim}$, the excess fibres which do not take part in forming the loop will appear on the reverse side of the product, consequently lowering the yield.

Furthermore, if the angle $\alpha$ becomes too high, the forces induced by the fibres also become too great, and the fibres risk being broken as a result.

Thus, in practice, a satisfactory compromise is obtained for $\alpha_{lim}$ of between 15° and 25°, depending on the length of the loop. It can be seen, therefore, that it is advantageous to produce a suitable reorientation of the fibres in relation to the direction of forward movement.

The length of the fibre employed and its orientation $\alpha$ are, of course, chosen so that there is a statistical certainty that each fibre will be involved in the formation of at least one loop and preferably of a number of successive loops.

By virtue of the process of the invention it is possible to envisage that 100% of the fibres will be looped.

The elementary looped fibres are next accumulated by compression in the direction of forward movement in order to form a transverse row of loops of the desired size or count. This accumulation enables very good parallelisation of the fibres to be obtained. At this stage, therefore, a thread exhibiting an undulating shape has therefore been formed, except for the twist.

According to a particularly preferred embodiment, the parallelised fibres in the form of loops are accumulated in the open eye of needles which are arranged perpendicularly between the mechanical members which have been used for the looping. The needles can then pierce, for example, a base and release the loops therein.

However, any other process for attaching loops to a support may be employed. By way of examples of processes derived from various textile techniques we may mention those such as needling, sewing, weaving, knitting, and the like.

FIG. 1 shows a carpet 1 which introduces a web of carded fibres 3, of very low weight per unit area.

In the embodiment shown the desired orientation of the fibres in the web is obtained with the aid of a set of interpenetrating discs which have been given the general reference 5.

By passing between the upper set of discs 5*a* and the lower set of discs 5*b* and bearing in mind the low weight per unit area of the product treated, a suitable orientation of the elementary fibres in relation to the forward travel of the card web is obtained by a transverse predrawing. This is a result of the resilience of the fibre which, after being looped, relaxes, and this increases its angle in relation to the direction of forward travel.

This predrawing device is also intended to adapt the width of the web to the working width of the looping device (preferably 4 m).

As already indicated, this operation, always bearing in mind the low weight per unit area of the web, constitutes drawing and not pleating, in the sense that the elementary fibres are oriented and move relative to each other to be positioned.

Reference 3*a* has been given to the low-density oriented web resulting from this operation.

In the next stage the web thus prepared is brought between a series of looping discs 11 carried on a common transverse shaft 13 and driven in continuous rotation at a peripheral speed equal to the speed of entry of the web.

The looping discs 11 are provided with teeth 15 over their whole periphery. These teeth form an angle to the tangent and enable the entering web to be picked up.

Looping fingers 21 which are essentially tangential in relation to the discs are arranged between each of the discs.

A needle 31 provided with an open eye 31*a* is arranged in the extension of each looping finger.

The needles are arranged so that the fibres leave the looping fingers at their end, where they encounter the needles, to accumulate in the open eye 31*a* at the top dead centre of their travel.

The shape of the looping fingers is perfectly designed to permit the fibres to be progressively looped and conveyed as far as the needles.

In addition, a stripping device 25 is inserted between the needles 31 and the looping discs 11 to facilitate the stripping of the part of the fibres which are picked up by the teeth.

According to another alternative embodiment it may be advantageous to provide movable "strippers".

The fibres in the form of elementary loops are accumulated in the eye of the needles, where they take the form of an untwisted thread which nevertheless assumes an undulating shape.

The technique just described can therefore be considered to have formed, by starting with a very lightweight web of fibres, the equivalent of an undulating thread which can be employed according to the conventional tufting techniques.

It should be noted that the count of this thread can be modified, since it depends on the relationship between the angular speed of the looping discs 11 and the beat speed of the needles 31.

In the embodiment shown the shaping takes place as follows. The loop of fibres which has formed in the eye 31*a* of the needle at the top dead centre of its travel is conveyed by this needle through a conventional base 41 (preferably nonwoven) and is retained by a hook 43. Members 45 which take, for example, the shape of parallel counterpressure strips attached to an anvil 47 support the base 41 while still allowing the needles 31 to pass through.

FIG. 2 shows an outline of the various stages of the process according to the invention in a number of views. In FIG. 2 the first upper row of figures shows the operations carried out by various constituent parts in question of the device in relation to the various stages of the process. The second row (middle row) and the third row (lower row) of figures show respectively top views and side views of the fibre arrangement according to these same stages of the process, until the final product is obtained.

Figures 2A, 2B, 2C, 2D, 2E:
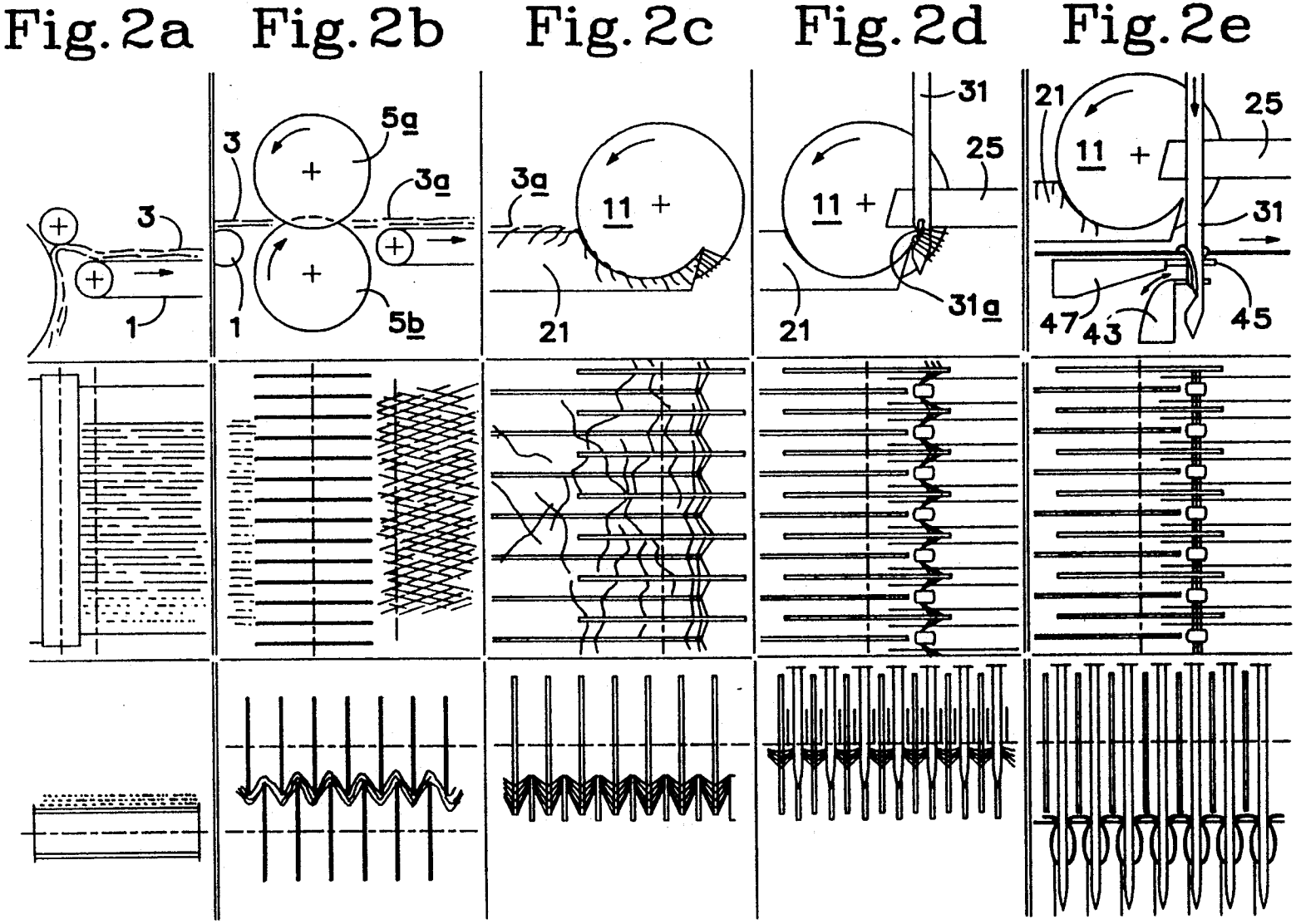
FIGS. 2*a–e* summarise various stages of the process according to the invention in a number of views.

The fibres leaving the card (FIGS. 2*a*) are oriented (FIGS. 2*b*) as desired. They are then condensed in the form of loops (FIGS. 2*c*) and accumulated in the eye of the needles (FIGS. 2*d*). The loops are next conveyed by the needles which pierce the base to be attached therein (FIGS. 2*e*).

However, other embodiments are possible and obtaining a product similar to the tuft without having to pass through the base can also be envisaged, for example by resorting to welding or chemical bonding techniques, preferably by resorting to an ultrasonic welding technique (FR-A-0,096,043).

It should be noted in this connection that the invention is not limited in any manner whatsoever to the embodiment which has been presented.

In particular, additional product finishing operations, stages or treatments may be provided upstream of the shaping of the web leaving the card or downstream of the shaping of the product according to the invention, or intervening in the process. Thus, for example, provision may be made for a knife to cut the loops or provision may be made for the loops to be cropped downstream to obtain products of the velvet type according to the conventional tufting techniques. Printing, quilting and deformations which are permanent or otherwise may be applied to the product.

Traditional dyeing, printing and impregnation with products giving protection against soiling are also possible, of course.

In addition, upstream, the progressive feed enables heterogeneities of colours and of natures of products to be condensed; as well as many fancy effects. By way of illustration, the web deposition may be fed with slubs, and the like.

Similarly, composite products which have loops consisting of two superposed layers can be obtained by feeding two superposed webs of different kind.

The lower layer may be chosen, for example, so as to provide the "body" while the peripheral layer offers a special aesthetic appearance or a pleasant feel.

A relative movement between the needles and the base which travels along can also be envisaged, for example by arranging the needles on a needle-carrier performing a shuttling transverse motion relative to the onward travel, enabling some effects of advantageous appearance to be obtained.

It is easier to obtain a relative motion using the jute mover technique which is known in the tufting field. This technique allows the base to be moved transversely by a distance equivalent to half a gauge before returning it to its initial position in the next stroke. By arranging the loops quincuncially and breaking the line of the rows of loops, this technique allows a better individualisation of these said loops and a better covering of the base thereby.

Using his or her usual knowledge of the art, a person skilled in the art will discover many alternative forms and applications by starting with the product of the invention. In particular, knitting and/or sewing operations can be superposed on the product. It is also possible to produce wick carpets by starting with the process according to the invention.

Figure 3:
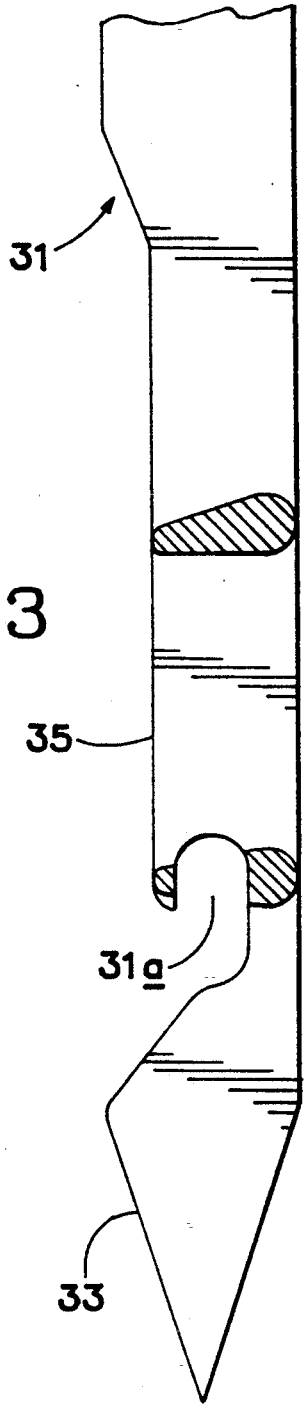
FIG. 3 is a side view of a needle appearing in the device according to the invention.

FIG. 3 shows the needle employed in the device according to the invention.

This is a needle with an open eye 31*a* which, seen in profile, has a point 33 width which is greater than that of the shank 35 of the needle. This dimensioning of the needle makes it possible to avoid the entry of the base into the eye 31*a* when the needle 31 pierces the said base and interfering with the withdrawal of the needle.

Needles of other types can, nevertheless, be employed, in particular stitching needles which allow the undulating "thread" to be organised in the form of rows of stitches.

The products permits and withstands operations of this kind essentially owing to its specific nature which has been described above.

The product obtained according to the process of the invention before the attachment to a base is in the form of an accumulation of well-parallelised fibres forming an undulating thread, except for the twist.

FIGS. 4 show the product according to the invention and a product of the tuft type after fixing to a base in three views: a plan view of the reverse side of the products and a view in side cross-section in each of the two directions parallel or at right angles to the direction of manufacture.

FIGS. 4*a* and 4*b* show these two products in the case where the loops are cut or shorn in order to obtain a velvet.

FIGS. 4*c* and 4*d* show the same two products in looped form, but using the jute mover technique.

The direction of manufacture of the products is symbolised in these figures by an arrow, the forward travel step by the letter a and the gauge by the letter j.

The products according to the invention shown in FIGS. 4*a* and 4*c* have rows of loops, or of tufts if the loops have been cut, which are perfectly individualised, thus reproducing the essential aesthetic nature of the tuft (shown in FIGS. 4*b* and 4*d*).

However, these rows of loops or of tufts are arranged transversely in the product according to the invention, whereas they appear lengthwise in the case of the tuft.

The fact of employing the jute mover technique in the process according to the invention, when compared with the tuft, makes it possible to reduce the consumption of fibres on the reverse side of the product and hence to increase their yield.

Moreover, a network of interfering fibres which consists of fibres taking part in the formation of the loops of two consecutive rows may remain between two consecutive rows of loops. When the process according to the invention is used, this number is greatly reduced, or even zero.

Another characteristic of the product obtained from a particular embodiment of the process is the fact that the holes in the base can be oversized in relation to the gauge size because of the use of a special needle, when compared with a tufted product.

The following values may be given to illustrate the parameters of a preferred embodiment of the invention:

Fibres with a count of 17 dtex and a mean length of 90 mm, produced by starting with a raw material which is polyamide, are carded in the form of a web which on leaving the card has a weight per unit area of 40 g/m$^2$.

This web is treated according to the embodiment shown in FIG. 1 so as to produce the following conditions:

weight per unit area after predrawing: 20 g/m$^2$
gauge: 4 mm (5/32")
forward speed of the base: 1.2 m/min
feeding speed of the fibre web: 48 m/min
web width: 4 m
beating speed of the needles: 600 strokes/min
average number of fibres which the eye can receive: 235
loop count: 4,000 dtex
loop height: 6 mm
loop density: 125,000 loops/m$^2$
useful velvet weight: 600 g/m$^2$
useful velvet density (mass per unit volume): 0.1 g/cm$^3$;
yield: 75%

In conclusion, the advantages of the process of the invention can be summarised as follows:

The economic advantage of the process is obvious, since it integrates the production of a thread with a device which makes it possible to obtain directly from individual fibres of filaments a product which is virtually identical with a tufted product, and therefore without having to employ a preliminary spinning stage.

As has been abundantly shown above, the product allows many operational variants and alternatives in the choice of materials, nature of the treatments, and the like, offering a great flexibility and consequently a wide range of products of variable appearance and nature.

In addition, because of their high density, these products can be employed as floor coverings. Their high yield also constitutes an economic factor which makes them particularly advantageous.

The gauge may be very fine, since the looping involves only a very small number of fibres individually. The product which is obtained may be of high added value as a result of the use of a very fine gauge.

Consequently, the forces to be applied are reduced, and this virtually eliminates the risk of fibre breakage and, of course, of needle breakage.

Although a particularly preferred embodiment of the invention has been described, it must be clearly understood that many alternative forms can be introduced therein, especially those which have been specifically mentioned above.

What is claimed is:

1. Process for manufacturing a textile product comprising:

depositing fibers in a moving web;

arranging fibers for forward travel in the form of a web, wherein most of the fibres of the web have an angle of orientation relative to the direction of forward travel of the web of between 5° and 45°;

transversely looping and simultaneously transversely drawing the fibers in the web; and accumulating the fibres relative to the direction of forward travel, in the form of loop in which the fibres are parallelised.

2. Process according to claim 1, wherein said depositing includes starting the web of fibres with a low weight per unit area, preferably between 10 and 50 g/m$^2$.

3. Process according to claim 1 wherein said arranging includes orienting the fibres such that most of the fibres of the web have an angle of orientation relative to the direction of forward travel of the web of between 15° and 25°.

4. Process according to claim 1 wherein said arranging includes a predrawing operation wherein the fibres are oriented relative to the direction of forward travel of the web.

5. Process according to claim 1 wherein said arranging includes producing the orientation of the fibres which consist of filaments relative to the direction of forward travel by a lapping operation on leaving the die for extruding the fibres.

6. Process according to claim 1, which includes forming loops in transverse rows and then integrally fixing the loops to a base (41).

7. Process according to claim 6 wherein said integral fixing is produced by passing a needle (31) through the base (41).

8. Process according to claim 6 wherein said integral fixing is produced by ultrasonic welding.

9. Process according to claim 6 which includes performing a transverse relative motion on each integral fixing between the base (41) and a transport (31).

10. Process according to claim 6 wherein said integrally fixing of the loops includes further treatment of the loops by cutting, shorning or cropping.

11. Process according to claim 1 which includes forming a row of stitches from a thread which is formed from an accumulation of well-parallelised elementary fibres.

12. Device for manufacturing a textile product from elementary fibres, in which the fibres travel in the form of a web in a forward direction, comprising rotary looping elements (11), for orienting fibres, arranged at spaced-apart distances on a shaft (13) which is transverse in relation to the forward travel of the web, which further includes lopping fingers, (21), for presenting the web to the looping elements (11), arranged between said rotary looping elements.

13. Device according to claim 12 wherein said looping members (11) include discs having peripheral teeth (15) thereon.

14. Device according to claim 12 wherein said looping fingers (21) are stationary.

15. Device according to claim 12 which further includes an array of looping fingers (21), each having an extension thereto, wherein said needles (31) each include an eye (31*a*), and wherein an accumulation of parallelised fibers in the form of loops takes place in the eyes (31*a*) of needles (31) and in the extension of the looping fingers (21), wherein said needles (31) are arranged between the rotary looping elements (11).

16. Device according to claim 15 which includes a needle (31) actuator, and wherein said needles (31) are actuated simultaneously to release the loops when the accumulation of fibres in the eyes (31*a*) of the needles

(31) is sufficient, preferably close to the value of maximum accumulation in said eye.

17. Device according to claim 15 which further includes a stripping device (25) which is insertable between the needles (31) and the rotary looping elements (11) in order to facilitate the stripping of the part of the fibres entrained by said rotary looping element (11).

18. Device according to claim 12 which includes two sets of interpenetrating discs (5*a* and 5*b*) which are constructed and arranged to obtain a suitable orientation of the elementary fibres.

* * * * *